US005745932A

United States Patent [19]

Barovetto

[11] Patent Number: 5,745,932

[45] Date of Patent: May 5, 1998

[54] HOT TUB COVER AND ENCLOSURE

[76] Inventor: David L. Barovetto, P.O. Box 269, Sun Valley, Id. 83353-0269

[21] Appl. No.: 755,393

[22] Filed: Nov. 22, 1996

[51] Int. Cl.[6] ..... E04H 4/08

[52] U.S. Cl. ..... 4/498; 4/494; 4/503; 52/66; 52/82; 220/254; 220/331

[58] Field of Search ..... 4/541.1, 494, 498, 4/500, 503; 52/66, 82; 220/254, 331

[56] References Cited

U.S. PATENT DOCUMENTS

| | | | |
|---|---|---|---|
| 1,494,780 | 5/1924 | Ford | 52/82 |
| 1,912,502 | 6/1933 | Stotzer et al. | 52/82 |
| 3,443,265 | 5/1969 | Hauck | 4/498 |
| 3,475,768 | 11/1969 | Burton | 4/498 |
| 3,559,215 | 2/1971 | Kormann | 4/172.12 |
| 3,683,427 | 8/1972 | Burkholz et al. | 4/503 |
| 3,683,428 | 8/1972 | Morris | 4/172.14 |
| 4,000,749 | 1/1977 | Busco | 4/498 |
| 4,073,105 | 2/1978 | Daugherty | 52/169.9 |
| 5,022,101 | 6/1991 | Gosselin et al. | 4/498 |
| 5,150,806 | 9/1992 | Glomski | 220/331 |
| 5,216,854 | 6/1993 | Emmert | 52/82 |
| 5,371,907 | 12/1994 | Horvath | 4/498 |
| 5,398,350 | 3/1995 | Watkins et al. | 4/498 |

*Primary Examiner*—Charles R. Eloshway
*Attorney, Agent, or Firm*—Frank J. Dykas

[57] ABSTRACT

A hot tub cover and enclosure which, when in a closed position, forms a waterproof cover for a hot tub and a sloping surface to shed snow and water, and when in an open position, provides privacy screening and wind protection. The side walls of the hot tub cover and enclosure are individually self-supporting, so that any side wall or combination of side walls may remain on the hot tub in a closed position, or any number of side walls may be placed in an open position or removed from the hot tub, without need for support from neighboring side walls. The side walls attach to the hot tub using a detachable hinging mechanism.

7 Claims, 6 Drawing Sheets

HOT TUB COVER AND ENCLOSURE

BACKGROUND OF THE INVENTION

TECHNICAL FIELD

The present invention generally relates to covers for hot tubs, and more particularly to a cover for a hot tub which also provides a sheltering structure for privacy and protection from the elements.

BACKGROUND

Hot tubs are devices in which water is kept at an elevated temperature and benches or seats are provided for the users of the hot tub to sit in the warm water. They are typically installed outside of the home. A cover of some type is usually placed over the top of the hot tub to insulate against heat loss, as well as to reduce evaporation and to reduce the volatilization of pool chemicals. The common hot tub cover currently in use is a large, flat, rigid structure containing foam insulation. This hot tub cover is typically covered with naughahyde, and consists of two pieces which are hinged together. The hinge in the middle is typically a fabric hinge, which allows the hot tub cover to be folded upon itself in half. The hot tub cover must be removed from the hot tub before the hot tub can be used. This is accomplished by folding the hot tub cover in half and then sliding the folded hot tub cover to one side, or completely off of the hot tub.

This type of hot tub cover has some shortcomings. One is that moisture from snow and rainfall from above the hot tub cover, as well as condensation from below the hot tub cover, gradually is absorbed by the foam insulation, and the hot tub cover becomes saturated with water and thus very heavy to move. Existing hot tub covers form a flat surface across the top of the hot tub, and are not provided with a way for shedding water from rainfall, nor for bearing the load of snowfall. The current hot tub covers also present a flat surface on to which children may be tempted to climb. When a hot tub cover has deteriorated with age, and the foam has become waterlogged and heavy, the weight of children on its flat surface may cause it to cave in, presenting a safety hazard to the children, as well as destroying the hot tub cover.

Hot tubs are sometimes fitted with a privacy screen which can consist of a wooden fence of trellis. The privacy screen also provides some protection from the wind. If a hot tub is not provided with a privacy screen, the hot tub covers in use today do not provide any kind of privacy or protective structure.

Another problem with the current design of hot tub covers is that there are large numbers of hot tub manufacturers, each with many models and many sizes of each model for sale. When a hot tub owner calls a hot tub cover supplier for a hot tub cover or a replacement hot tub cover, the hot tub cover supplier usually is required to make a trip to the site in order to measure the hot tub and order the right size of hot tub cover.

Another problem with current hot tub covers is that they provide inadequate insulation against heat loss.

Accordingly, it is an object of the invention to provide a hot tub cover which is designed to shed rainfall and snow loads. Another object of the invention is to provide a hot tub cover which provides better insulative characteristics than the current hot tub cover. A further object of the invention is to provide a hot tub cover which provides a privacy screening, a wind screen, and a rain shield, for the hot tub while it is in use.

A further object of the invention is to provide a hot tub cover which is designed to discourage the use of its upper surface by children.

Another object of the invention is to provide a hot tub cover which can be utilized on a number of different hot tub models and sizes. This versatility saves a hot tub cover supplier a trip to the site to measure the dimensions of the hot tub for which a cover is being ordered.

DISCLOSURE OF INVENTION

These objects are achieved in a hot tub cover and enclosure which is adapted for use on a hot tub. A typical configuration will be for a hot tub which has four sides. In that configuration, the hot tub cover and enclosure will also have four sides, but other configurations are possible in which the hot tub cover and enclosure may have three, four, five, six or more sides to match the number of sides of the hot tub. The basic configuration of the hot tub cover and enclosure includes a number of trapezoidal side walls, called shields. Each of the side walls has an interior surface and an exterior surface. When joined together, the trapezoidal side walls form a structure which has an apex. Each of the trapezoidal side walls are individually self supporting, meaning that each can be placed in an open or a closed position without requiring the support of the neighboring side walls. Each side wall is also dismountable from the hot tub.

Each side wall is attached to a hot tub side wall by a loop and hook or some other method of hinging. Each side wall is provided with a way to pull the side wall from a closed position to an open position from outside the hot tub. This can consist of a ridge which is integral with the exterior surface of the side wall, but can also be a strap, or a handle bolted to the side wall, or other means of providing a hand grip for the side wall.

The hot tub cover and enclosure, when in a closed position, may leave an opening at the ends of the side walls. This opening can be closed by placing a cap upon it. This cap can be used on some of the side walls when other of the side walls have been removed or placed in an open position.

The hot tub cover and enclosure described above can also include a means for controlling the condensation on the interior surface of the closed side walls. This can take the form of a steep or vertical section of the interior surface of the side wall which ends in a condensation drip line, from which condensation on the inner surface of the side walls flows and drips into the water of the hot tub.

The hot tub cover and enclosure described above can utilize trapezoidal side walls which are hollow or insulated. This hot tub cover and enclosure can have side walls which are dismountable by the use of a loop and hook device which has a disengaging fitting. This disengaging fitting allows the side wall to be lifted off of the hot tub. The hot tub cover and enclosure described above will typically have side walls with mating edges which form a water tight seal between the trapezoidal side walls.

BEST MODE FOR CARRYING OUT INVENTION

Referring to FIGS. 1 through 8, the hot tub cover and enclosure is illustrated in its preferred embodiment.

Figure 1:
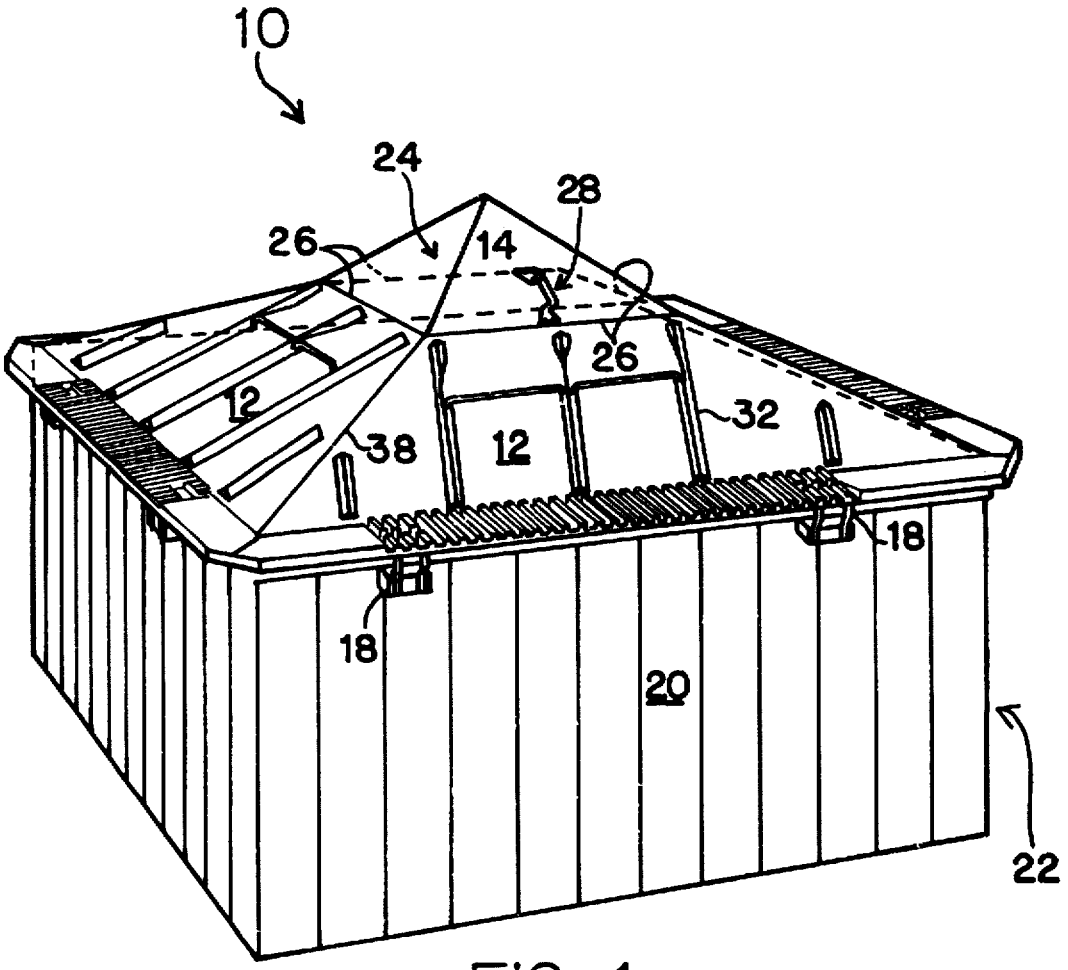
FIG. 1 is a perspective view of a hot tub with the hot tub cover and enclosure installed.

The basic concept of the invention is that there are four trapezoidal side walls 12 (also called shields or just side walls) which are mounted to the four sides 20 of a hot tub 22. Although described a trapezoidal, configurations such as triangular, polygonal, or square could also be used in the practice of the invention. The side walls 12 are attached by a loop 18 to the hot tub side 20. As shown in FIG. 1, when the four side walls 12 are in their closed position, they form a pyramid-shaped hot tub cover and enclosure. Although the side walls 12 could extend to completely cover the hot tub, in the preferred embodiment do not extend to form a closed pyramid. Instead, the side walls 12 join to form a truncated pyramid-shaped cover, with a square opening 24 formed by their top edge 26. Although a hot tub cover and enclosure of four side walls 12 is shown, other configurations could have three, five, six or more side walls 12.

In the preferred embodiment, this opening 24 is covered by cap 14. Cap 14 is a pyramid-shaped cap which is placed on the top edges 26 of side walls 12. Cap 14 has a handle 28 with which cap 14 can be lifted off the side walls 12. It can also have a locking and releasing mechanism using a release button, hook, buckle, hook and loop, or other method.

Figure 2:
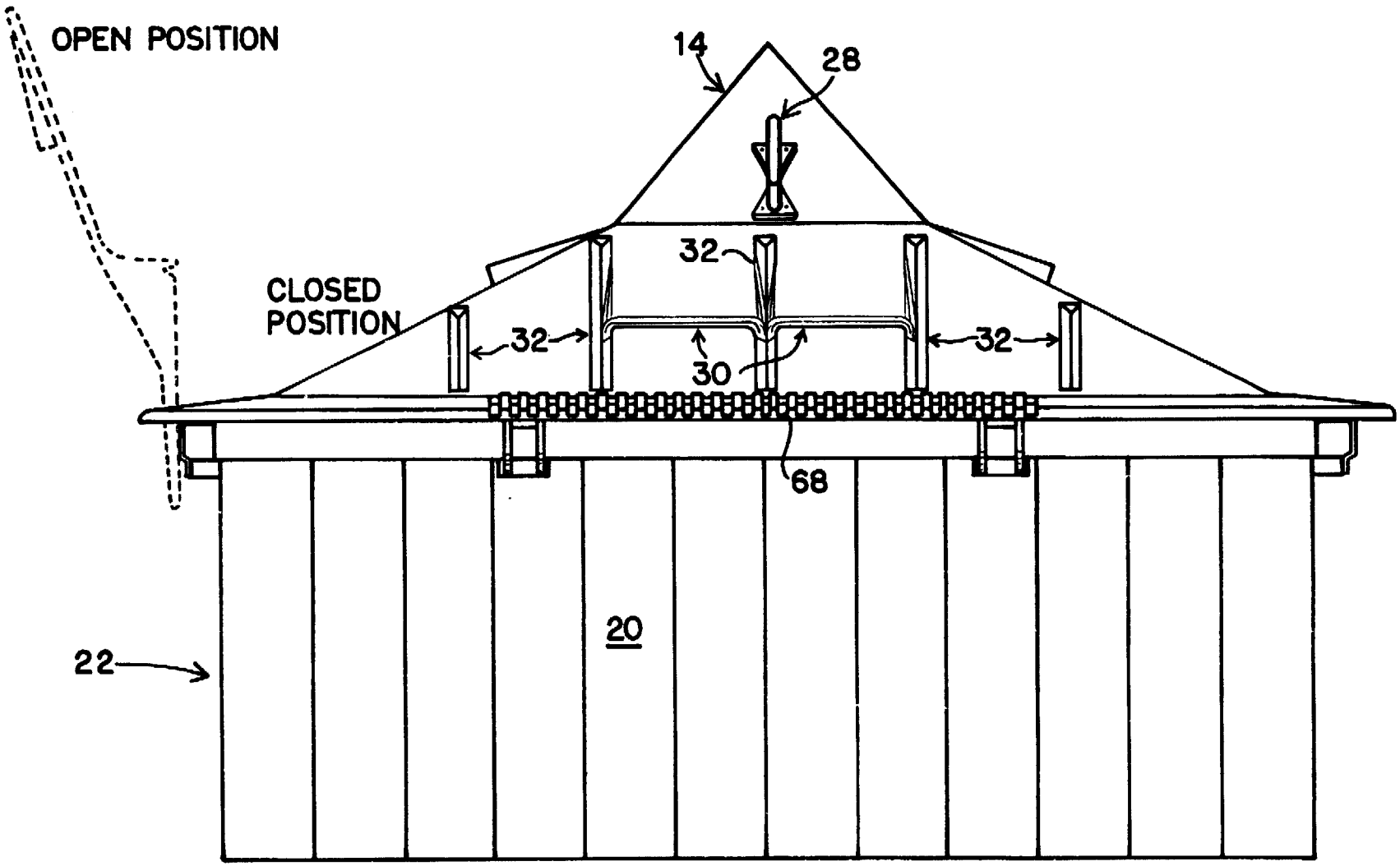
FIG. 2 is a side view of a hot tub with the hot tub cover and enclosure installed.
Figure 3:
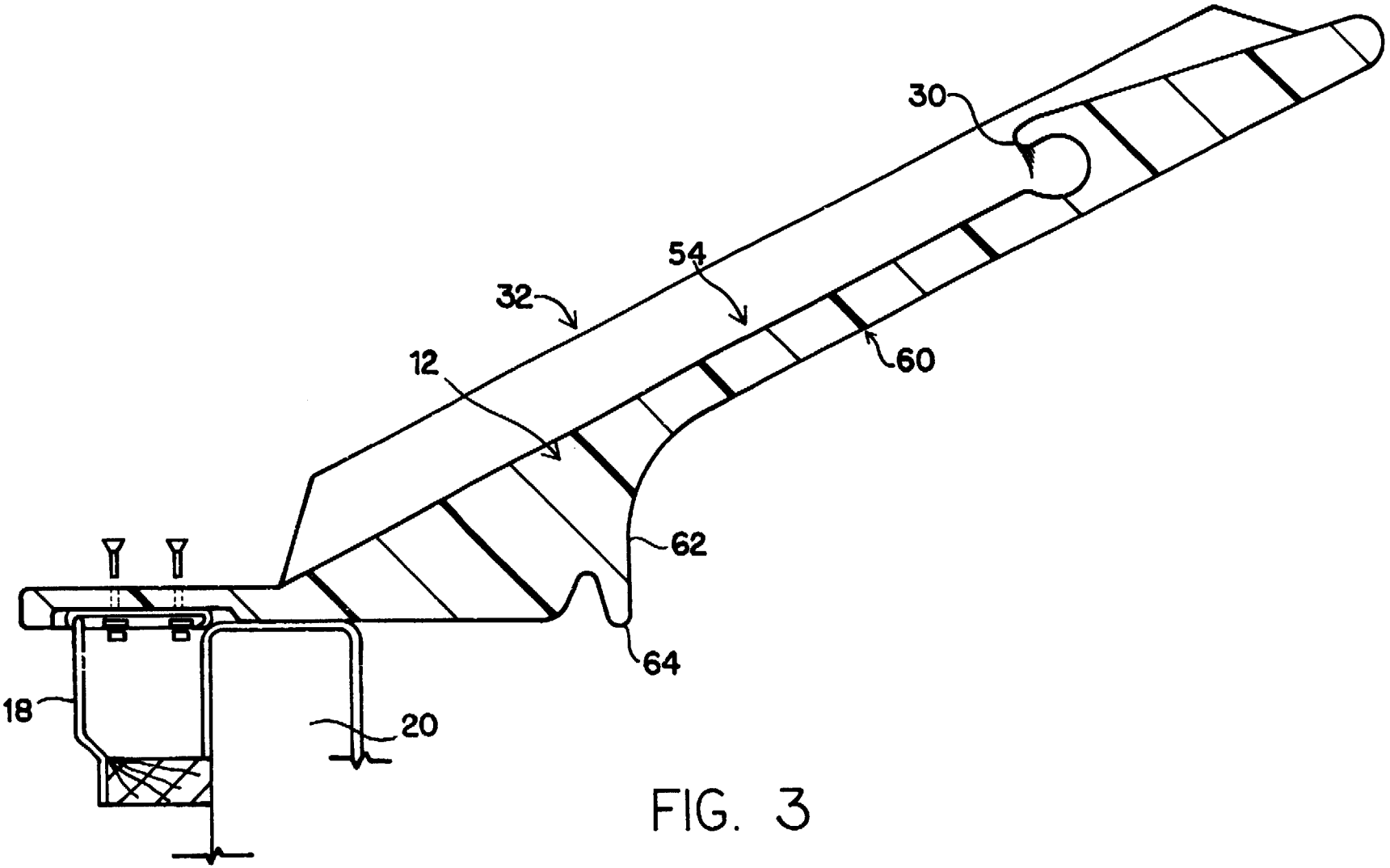
FIG. 3 is a side cross-sectional view of a wall of a hot tub and a side wall of the hot tub cover and enclosure.

Side walls 12 each contain a gripping ridge 30. This gripping ridge 30 is best shown in FIG. 2 and in FIG. 3 in cross section. Gripping ridge 30 is a ridge or lip as shown in FIG. 3 and 2 which provides a handle for the user to pull a side wall 12 away from its closed position into an open position. FIG. 2 shows a side wall thus pulled into an open position as a dotted line on the left-hand side of the hot tub 22. The exterior surface 54 of side wall 12, besides containing a gripping ridge 30, also contains reinforcing ribs 32. Each side wall 12 has two mating edges 38, where neighboring side walls 12 meet. A grip can also be provided on an interior surface of a trapezoidal side wall.

Figure 4:
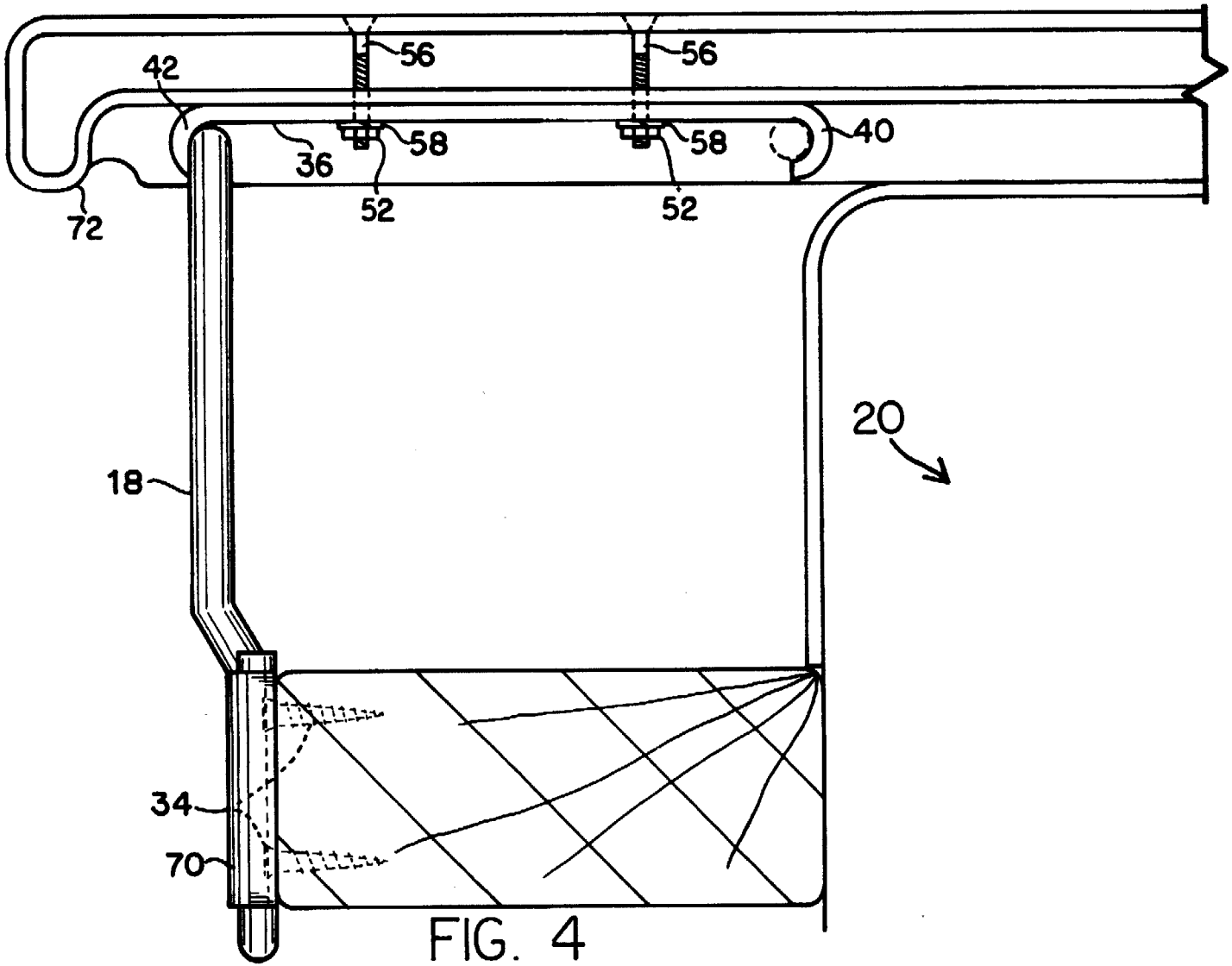
FIG. 4 is a cross-sectional side view of the detachable hinging mechanism of the hot tub cover as it is attached to the side of the hot tub and a side wall.
Figure 5:
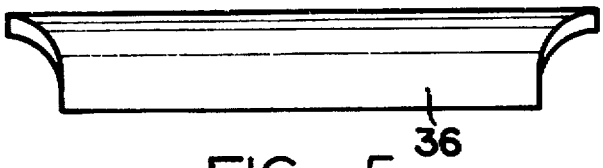
FIG. 5 is an end view of the hook in slide plate.
Figure 6:
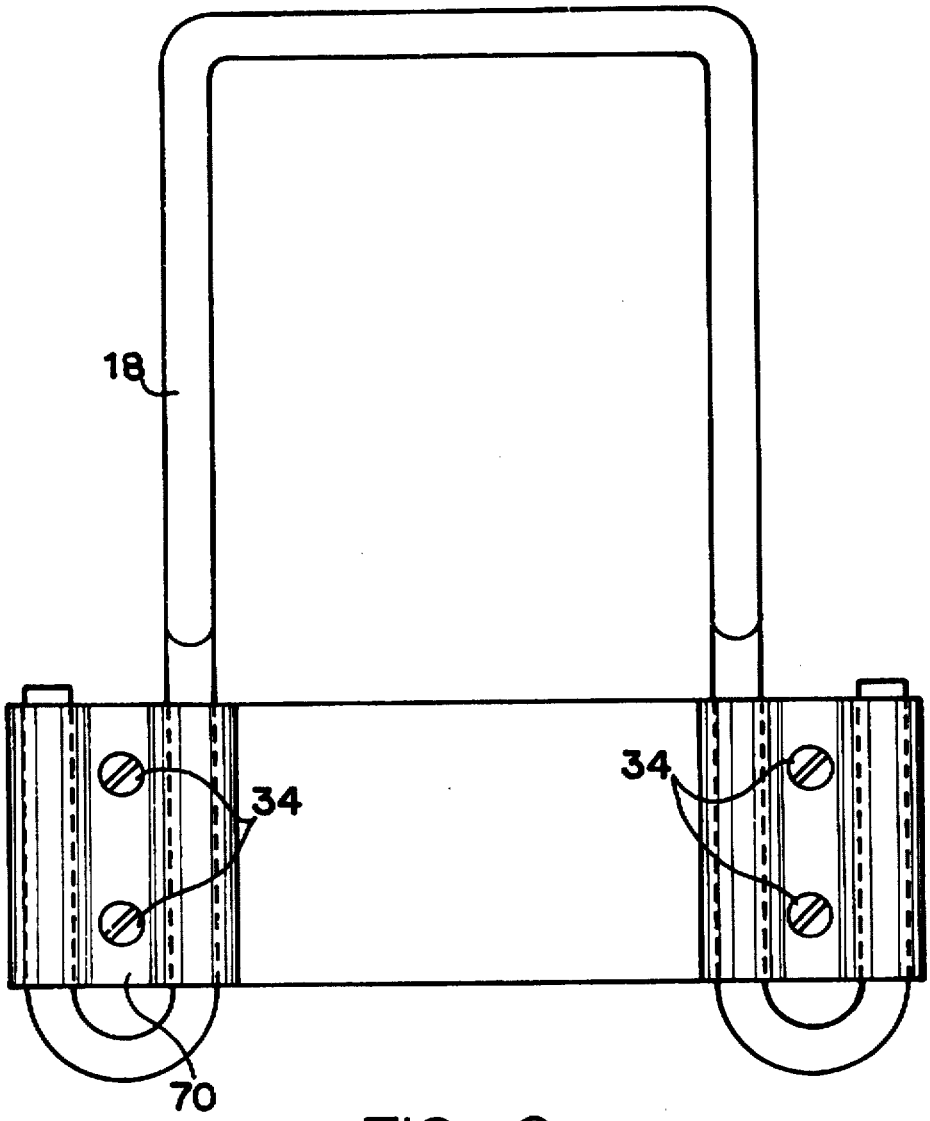
FIG. 6 is a front view of a detail of the hot tub cover hinging and holding mechanism.
Figure 7:
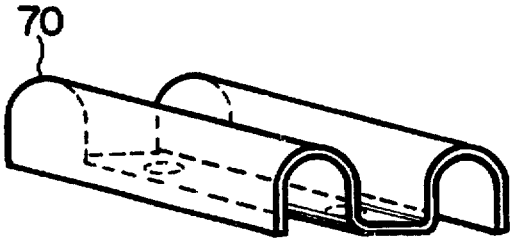
FIG. 7 is a perspective view of the clamp which is used to attach the loop to the side of the hot tub.
Figure 8:
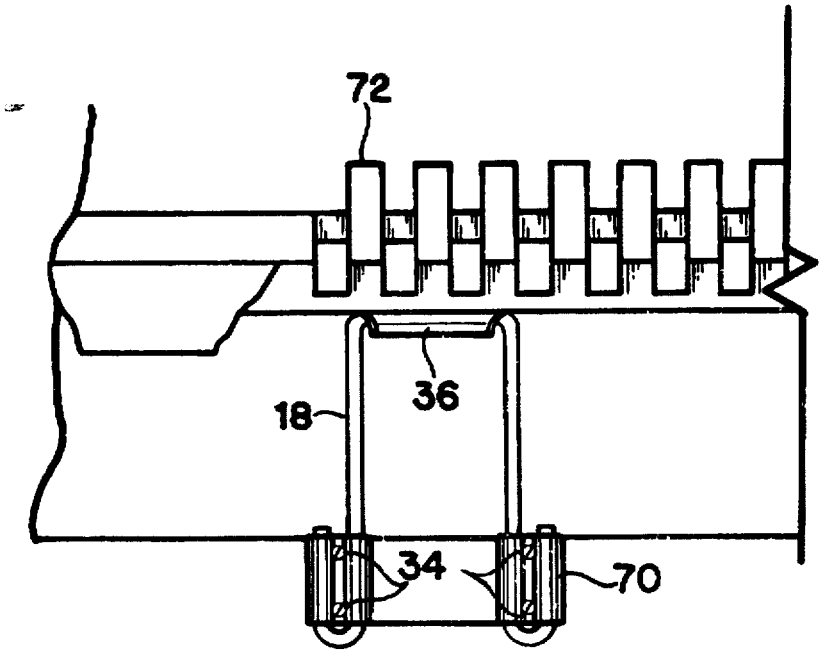
FIG. 8 is a front view of the hot tub cover as it attaches to a hinging and holding mechanism and the side of a hot tub.

Each side wall is designed to be self supporting in its closed position or in its open position. This means that any side wall 12 or combination of side walls 12 can be left in the closed position and any number can be placed in the open position or removed from the hot tub side 20. These functions are accomplished by the detachable hinging mechanism shown in FIGS. 3 through 8. FIG. 3 is a cross-sectional side view of side wall 12 mounted to hot tub side 20. FIG. 4 is a detail of the cross-sectional side view, and FIGS. 5–8 are further details of the hinging mechanism. It consists of loop 18, which is mounted to hot tub side 20 by clamps 70 and screws 34. Clamp 70 is shown in perspective in FIG. 7. Hook and slide plate 36 is a generally flat and rectangular piece of metal which is curved at each of its two ends into first hook 40 and second hook 42, with the inside diameters of the hooks 42 and 40 matching the cross-sectional diameter of loop 18. Hook and slide plate 36 is mounted to side wall 12 by bolts 56, nuts 52 and washers 58. These are best shown in FIGS. 4–8.

The interior surface 60 of side wall 12 has a vertical inner wall 62 which forms a condensation drip line 64 along the inside surface 60 of each side wall 12.

It should be apparent to those skilled in the art that there are a number of other hinging and disengaging designs which may work similarly to the design shown in the preferred embodiment. These include hinges which disengage by removal of the hinge pin, hook and bar devices, tab and slot, devices and other possible detaching hinge mechanisms.

In practice, a pair of loops 18 are mounted to each hot tub side 20, using bolts 34 and clamps 70. Corresponding to the position of each loop 18, a double hook and slide plate 36 is mounted to a side wall 12, by drilling a hole through side wall 12 and using bolts 56, nut 52 and washer 58.

To mount a side wall 12 on to the hot tub 22, the side wall 12 is held in a vertical position. Side wall 12 is brought into proximity with loop 18 so that hook and slide plate 36 contacts loop 18. Side wall 12 is then lowered while hook and slide plate 36 is pressed against loop 18, side wall 12 is thus lowered until first hook 40 of hook and slide plate 36 engages loop 18. In that position, side wall 12 is in an open position, as shown in FIG. 2. To move from an open position to a closed position, side wall 12 is rotated from a vertical position to a horizontal position, with first hook 40 in continual contact with loop 18. Once side wall 12 is in a horizontal position, it is slid toward the interior of the hot tub 22, so that hook and slide plate 36 slides over loop 18 until loop 18 contacts second hook 42. In that position, second hook 42 supports side wall 12 in its closed position, and any particular side wall 12 may be thus positioned without the need for the support of its neighboring side walls 12.

To disengage any side wall 12 from the hot tub 22, the side wall 12 is first slid horizontally away from the center of hot tub 22 until first hook 40 engages loop 18. From that position, side wall 12 is raised to an open position as shown by the dashed line in FIG. 2. From that position the side wall 12 is lifted vertically until the loop 18 no longer engages the hook and slide plate 36 at the first hook. Once free of engagement, any side wall 12 can be removed from the hot tub 22 and moved to another location for storage. Each side wall 12 does not require the support of its neighboring side walls when in its open or closed position. In its closed position, as shown in solid lines in FIG. 2, each side wall is supported by the engagement of hook and slide plate 36 and second hook 42 with loop 18. All four side walls 12 can be mounted on the hot tub 22 in this manner and capped with cap 14.

To use the hot tub 22, cap 14 is removed using handle 28, exposing opening 24. At that point, at least one side wall 12 must be removed to allow access to hot tub 22. Typically, the users of the hot tub will access the hot tub from one preferred side. The side wall 12 on the preferred side of entry of the hot tub 22 may be referred to as the gate shield. The side wall 12 which is removed for access may be replaced and placed in its closed position after the user has entered the hot tub 22. If all four of the side walls are left in a closed position, they provide maximum privacy and protection from the elements for the user. With all four side walls in their closed position, cap 14 can be replaced on opening 24, creating an enclosure which combines the qualities of a hot tub with those of a sauna. By removing cap 14 but leaving all four side walls 12 in their closed position, more ventilation is provided, but the maximum in privacy and wind and rain protection is afforded. Alternatively, one side wall may be placed in the upright position or two side walls on opposite sides may be placed in the open position or removed. In this configuration, the two or three remaining side walls provide considerable privacy and wind screening effect and if cap 14 is placed on the top, provide an open air hot tub experience while protected from rainfall, hail or snow from overhead.

Another configuration of the hot tub enclosure and cover is with three or four of the side walls 12 in an open position. In this configuration, the upright side walls provide considerable wind protection and privacy, but are open to the sky. In one alternate preferred embodiment, a privacy screen or netting can be suspended between the mating edges 38 of the side walls 12 when they are in the open position. In this way, the hot tub 22 is provided with privacy screening as a part of the design of the hot tub enclosure and cover.

If desired, all four of the side walls 12 can be removed from hot tub 22 and placed in a storage position in another location.

The center edge portion 68 of each side wall 12 is provided with kiss-offs 72. These are provided to enhance the structural strength and rigidity of side walls 12 in the region of the attachment of hook and slide plate 36. Holes can be drilled for bolts 56 to pass through the solid plastic valley between kiss-offs 72. This provides a structurally favorable location for drilling holes and for providing support to the attachment of hook and side plate 36 to the trapezoidal side wall 12. The kiss-offs 72 also present a surface which is uncomfortable for children to climb on. As they place their knees on this surface to climb on to the hot tub cover and enclosure 10, the kiss-offs 72 hurt their knees and discourage such climbing by children.

When the four side walls 12 and the cap 14 are in place, a water tight rigid structure is in place over the hot tub 22. The exterior surface 54 of the side walls 12 form a sloping surface which tends to shed snow and rainfall. As the weight of any accumulated snow presses down on the side walls 12, the mating edges 38 of the side walls 12 are pressed into a tighter fit with its neighbor. This structure is inherently stronger than a flat-surface hot tub cover, and thus is less likely to be crushed or broken if children climb on the surface.

When the four side walls 12 of the hot tub cover and enclosure are in their closed position and capped with cap 14, there is provided a substantial enclosure of insulating air over the surface of the warm water. This layer of air is much thicker than the layer of air in a conventional hot tub covered by a conventional hot tub cover. This thicker layer of air provides more insulation from heat loss by the water. The side wall 12 can also be filled with insulation which fills the void between interior surface 60 and exterior surface 54, thus providing further insulation to the hot tub cover and enclosure.

While there is shown and described the present preferred embodiment of the invention, it is to be distinctly understood that this invention is not limited thereto but may be variously embodied to practice within the scope of the following claims.

I claim:

1. A cover and enclosure for a hot tub which has sides and an interior for holding water, comprising:

a. a plurality of individually self-supporting trapezoidal side walls, each having an exterior surface and being separately movable between an open position adjacent a respective one of the sides of the hot tub and a closed position over the hot tub interior;

b. hinging means for permitting movement of each trapezoidal side wall between the open and closed positions and for detachably connecting each trapezoidal side wall to a respective one of the sides of the hot tub; and c. gripping means for moving the trapezoidal side walls between the open and closed positions; wherein in the closed position, the trapezoidal side walls form an upwardly angled enclosure for deflecting rain and snow away from the hot tub interior and, in the open position, the trapezoidal side walls are substantially vertical and provide wind screening and privacy for users in the hot tub interior.

2. The hot tub cover and enclosure of claim 1 which further comprises a cap for placement atop the trapezoidal side walls when the trapezoidal side walls are in the closed position, the cap forming the apex of the structure enclosure.

3. The hot tub cover and enclosure of claim 1 which further comprises a means for condensation flow control.

4. The hot tub cover and enclosure of claim 1 wherein the gripping means is a ridge integral with the exterior surface of each trapezoidal side wall.

5. The hot tub cover and enclosure of claim 1 wherein the trapezoidal side walls are insulated.

6. The hot tub cover and enclosure of claim 1 in which the hinging means comprises a loop and hook.

7. The hot tub cover and enclosure of claim 1 wherein the trapezoidal side walls have mating edges, and the mating edges form a watertight seal between adjacent trapezoidal side walls when the trapezoidal side walls are in the closed position.

* * * * *